US006201514B1

(12) United States Patent
Iwasawa et al.

(10) Patent No.: US 6,201,514 B1
(45) Date of Patent: Mar. 13, 2001

(54) STEREOSCOPIC ANTENNA

(75) Inventors: Masashi Iwasawa; Ryosuke Miwa, both of Otsu (JP)

(73) Assignee: Optex Co., Ltd., Shiga (JP)

( * ) Notice: Subject to any disclaimer, the term of this patent is extended or adjusted under 35 U.S.C. 154(b) by 0 days.

(21) Appl. No.: 09/471,506

(22) Filed: Dec. 23, 1999

(30) Foreign Application Priority Data

Dec. 28, 1998 (JP) ..... 10-372244

(51) Int. Cl.[7] ..... H01R 1/36
(52) U.S. Cl. ..... 343/895; 343/841
(58) Field of Search ..... 343/895, 700 MS, 343/741, 742, 866

(56) References Cited

U.S. PATENT DOCUMENTS 5,818,398 * 10/1998 Tsuru et al. ..... 343/895
6,034,651 * 11/1998 Enguent ..... 343/895

* cited by examiner

*Primary Examiner*—Don Wong
*Assistant Examiner*—James Clinger
(74) *Attorney, Agent, or Firm*—Price and Gess

(57) ABSTRACT

A stereoscopic antenna includes a planar electroconductive pattern 2 adapted to be grounded, a loop-shaped antenna body 3 having an axis C0 lying perpendicular to the planar electroconductive pattern 2, and an antenna connection 4 for connecting the antenna body 3 to the planar electroconductive pattern 2. In this stereoscopic antenna, the ratio H/D of the longer diameter D of the antenna body 3 relative to the height H of the antenna body 3 as measured from the planar electroconductive pattern 2 is chosen to be within the range of 0.1 to 1. By making the antenna to have a three-dimensional structure different from any of the loop antenna and the rod antenna, the stereoscopic antenna compact in size can be obtained having a uniform field radiation pattern and giving rise to an increased gain.

14 Claims, 6 Drawing Sheets

STEREOSCOPIC ANTENNA

BACKGROUND OF THE INVENTION

1. Field of the Invention

The present invention generally relates to a stereoscopic antenna for use in connection with a security detector for transmitting a radio signal indicative of detection of the presence of a person and, more particularly, to the stereoscopic antenna capable of exhibiting a uniform pattern of field radiation.

2. Description of the Prior Art

The radiation directional characteristic (directivity) and the field gain are important characteristics of the antenna. The isotropic antenna is capable of radiating energies uniformly in all directions and the curve descriptive of the directivity (directivity diagram) thereof represents a circle in all planes. Requirements for the directivity of the antenna vary depending on the application, but the antenna used in a transmitter of the security detector is desired to be isotropic because the position of the transmitter antenna relative to the receiver varies depending on the place for installation of the security detector.

The rod antenna, an elongated antenna represented by a dipole antenna, is known as a highly efficient antenna capable of exhibiting a high field gain. However, in the case of a micro dipole antenna 100 elongated in a direction z as shown in FIG. 5A, the micro dipole antenna 100 is not isotropic since although the non-directivity is exhibited in the plane perpendicular thereto, that is, in an x-y plane as shown by a line 101 in FIG. 5B, but the 8-shaped directivity is exhibited in a plane containing the micro dipole antenna 100, that is, in the y-z plane as shown by a line 102 in FIG. 5C. Also, in order for the rod antenna to exhibit a high efficiency, it is necessary that the length of the rod antenna as measured in a direction z which conforms to the heightwise direction has to be chosen to be of a value equal to $\lambda/2$, $3\lambda/8$ or $\lambda/4$ to thereby allow it to resonate at the wavelength $\lambda$. This results in the rod antenna having a substantial length and, thus, in difficulty in making it compact.

A loop antenna 110 shown in FIG. 6A is of a design easy to make it compact. The loop antenna 110 is generally used having a perimeter chosen to be of a value equal to the wavelength $\lambda$. However, even the loop antenna 110 tends to exhibit the 8-shaped directivity in a y-z plane containing the loop antenna 110 as shown by a line 112 in FIG. 6C, and therefore, the loop antenna is not isotropic. Also, the loop antenna 110 has a field gain smaller than that of the rod antenna.

SUMMARY OF THE INVENTION

Accordingly, the present invention is intended to provide an stereoscopic antenna which is compact in size, can exhibit a uniform field radiation pattern and has a high gain.

In order to accomplish the above described object, the present invention provides a stereoscopic antenna which comprises a planar electroconductive pattern adapted to be grounded, a loop-shaped antenna body having an axis lying perpendicular to the planar electroconductive pattern, and an antenna connection for connecting the antenna body to the planar electroconductive pattern. The ratio H/D of the longer diameter D of the antenna body, as measured in a direction along the major axis thereof, relative to the height H of the antenna body as measured from the planar electroconductive pattern is chosen to be within the range of 0.1 to 1.

According to the present invention, the stereoscopic antenna is in the form of a loop, not in the form of a long wire, and is therefore compact in size. Also, since the ratio H/D of the longer diameter D of the antenna body relative to the height H of the antenna body as measured from the planar electroconductive pattern is chosen to be not smaller than 0.1 and the steroscopic antenna of the present invention is provided with the antenna connection, the stereoscopic antenna of the present invention is quite different in structure from the loop antenna. On the other hand, since the ratio H/D of the longer diameter D relative to the height H is not greater than 1, the stereoscopic antenna of the present invention is quite different in structure from the rod antenna. Thus, by making the antenna to have a three dimensional structure including the antenna body and the antenna connection, the stereoscopic antenna having a isotropy in which the field radiation pattern is uniform can be obtained. With this structure, the capacitance component of the antenna can depend on the distance between the electroconductive pattern and the antenna body and the inductance component thereof can depend on the overall length of the antenna. Accordingly, tuning of the stereoscopic antenna can be accomplished by adjusting the distance between the electroconductive pattern and the antenna body and also the overall length of the antenna and need not be lengthened as is the case with the rod antenna which is required to be lengthened in order for the antenna to tune. Accordingly, the present invention makes it possible to compactize the antenna. Yet, by tuning the antenna, the gain of the antenna can be increased advantageously.

In a preferred embodiment of the present invention, the planar electroconductive pattern has an opposed portion extending substantially circumferentially thereof and positioned so as to axially confront the antenna body. According to this structure, since the opposed portion of the planar electroconductive pattern has a dimension on a plane which is about equal to that of the antenna body, the capacitance component can be increased to achieve the tuning of the antenna.

In another preferred embodiment of the present invention, the antenna body is formed in one to four turns. According to this structure, if the antenna body has a number of turns which is greater than four turns, the stereoscopic antenna of the present invention will have a shape approaching the shape of the rod antenna and no sufficient characteristic in terms of directivity and gain will be obtained. However, the choice of a number of turns not greater than the four turns makes it possible to provide the stereoscopic antenna having an isotropy and an increased gain.

BRIEF DESCRIPTION OF THE DRAWINGS

In any event, the present invention will become more clearly understood from the following description of a preferred embodiment thereof, when taken in conjunction with the accompanying drawings. However, the embodiment and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

DETAILED DESCRIPTION OF THE EMBODIMENT

A preferred embodiment of the present invention will now be described with reference to the accompanying drawings.

Figure 1A:
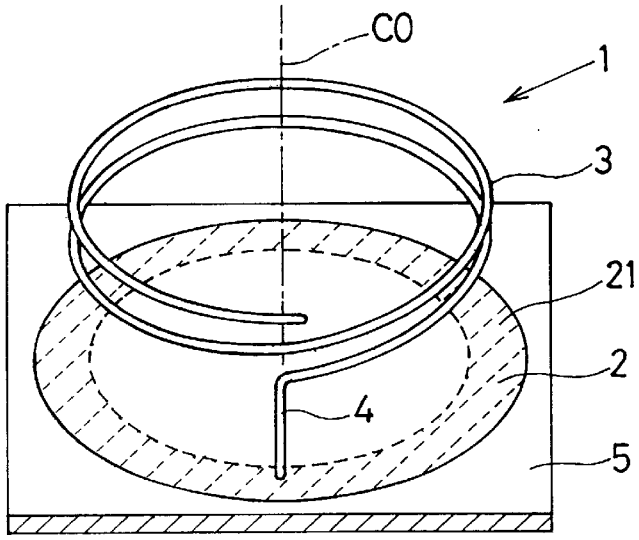
FIG. 1A is a perspective view of a stereoscopic antenna according to a preferred embodiment of the present invention.
Figure 1B:
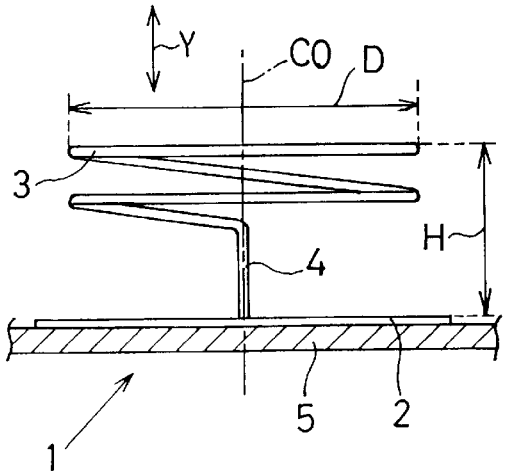
FIG. 1B is a side view of the stereoscopic antenna shown in FIG. 1A.
Figure 1C:
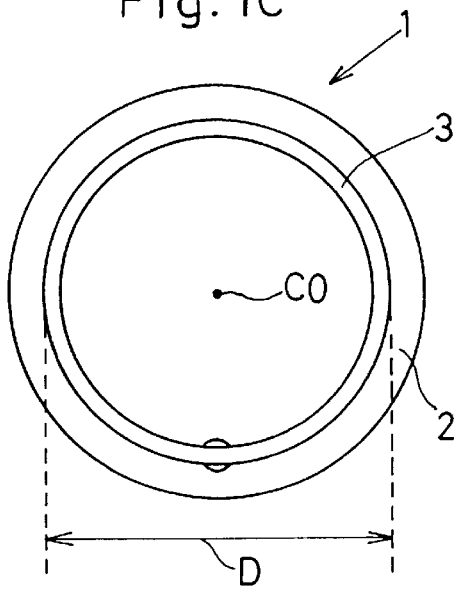
FIG. 1C is a to plan view of the stereoscopic antenna shown in FIG. 1A.

Referring first to FIG. 1A, a stereoscopic antenna 1 embodying the present invention comprises a planar electroconductive pattern 2 which is adapted to be grounded to the earth (not shown), a spirally looped antenna body 3 having an axis C0 perpendicular to the electroconductive pattern 2, and antenna connection 4 connecting the antenna body 3 to the electroconductive pattern 2. The illustrated stereoscopic antenna 1 is particularly suited for use in a transmitter of a security detecting system. The electroconductive pattern 2 is formed by patterning an electroconductive path on a substrate 5 made of an electrically insulating material such as a synthetic resin. As shown in FIGS. 1B and 1C, the ratio H/D of a longer diameter D of the antenna body 3 relative to the height H of the antenna body 3 as measured from the electroconductive pattern 2 is chosen to be about 0.5. The ratio H/D suffices to be within the range of 0.1 to 1 and, preferably, 0.5. If the ratio H/D is smaller than 0.1, the stereoscopic antenna would assume both a structure and a characteristic which are similar to those of the conventional two-dimensional loop antenna, but if the ratio H/D is greater than 1, the stereoscopic antenna would assume both a structure and a characteristic which are similar to those of the conventional rod antenna. Accordingly, selection of the ratio H/D within the range of 0.1 to 1 renders the stereoscopic antenna of the present invention distinct from any of the conventional loop antenna and the conventional rod antenna and is effective to allow the stereoscopic antenna of the present invention to have an isotropy in which the field radiation pattern is uniform. Also, by allowing the antenna of the present invention to be stereoscopic in structure, the capacitance component of the antenna can depend on the distance between the electroconductive pattern 2 and the antenna body 3 and, on the other hand, the inductance component thereof can depend on the overall length of the antenna. Accordingly, in order to allow the antenna to tune, it is sufficient to adjust the distance between the electroconductive pattern 2 and the antenna body 3 and the overall length of the antenna 1.

The antenna body 3 and the antenna connection 4 are prepared from a single electroconductive wire of a round cross-section with the antenna connection 4 extending parallel to the axis of the antenna body 3. Accordingly, the antenna connection 4 is formed by bending one end of the spirally looped antenna body 3 so as to extend perpendicular to the antenna body 3.

Although in the illustrated embodiment the antenna body 3 when projected onto a plane and viewed in a direction conforming to the axial direction Y represents a circular looped shape, it may be of any other looped shape such as, for example, oval, elliptical or polygonal or a squared shape.

The longer diameter D of the antenna body 3 is intended to means the longest one of distances measured between opposite points of the spirally looped antenna body 3 and may be a diameter of the circle if the spirally looped antenna body 3 represents a round shape as is the case with the illustrated embodiment.

As shown in FIG. 1A, the electroconductive pattern 2 is of a disc shape made of an electroconductive material. A peripheral portion of the electroconductive pattern 2 represented by a hatched area has an annular opposed portion 21 extending along the circumference thereof and positioned so as to confront the antenna body 3 in the axial direction Y. This annular opposed portion 21 has an outer diameter, a dimension on a plane, which is as large as the antenna body 3 and, therefore, the antenna can be tuned with the capacitance component increased. The electroconductive pattern 2 may be of any suitable shape matching with the shape of the antenna body 3 and, hence, may be oval, elliptical, polygonal or squared when viewed in a plane.

The spirally looped antenna body 3 so far shown is formed to have two turns. The term "two turns" is intended to means that the antenna body 3 is formed by turning the electroconductive wire twice so as to have a diameter D. If the antenna body 3 has a number of turns greater than 4, the resultant antenna would represent a shape approaching the shape of the conventional rod antenna and, therefore, sufficient gain and isotropic radiation would hardly be obtained. Accordingly, the antenna body 3 employed in the stereoscopic antenna 1 of the present invention preferably has the number of turns within the range of 1 to 4, preferably two turns in terms of productivity and compactization.

Although in the illustrated embodiment, the electroconductive pattern 2 has been described as having the disc shape, it may be of a ring shape of a size sufficient to encompass the annular opposed portion 21. Also, the annular opposed portion 21 although continuous over the entire circumference thereof in the illustrated embodiment may have one or more depleted zones. In other words, the opposed portion may be of any suitable shape provided that a predetermined capacitance component can be secured.

Figure 2A:
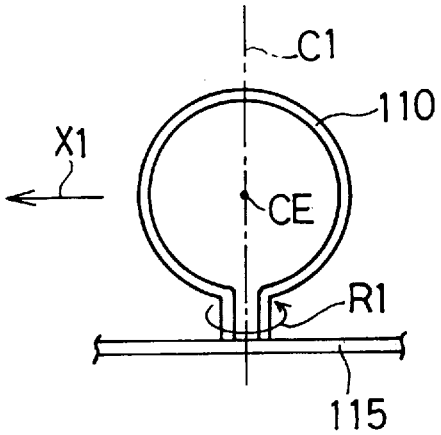
FIG. 2A is a front elevational view of the prior art loop antenna, showing a method of measuring the field gain of the prior art loop antenna in an X-axis direction.
Figure 2B:
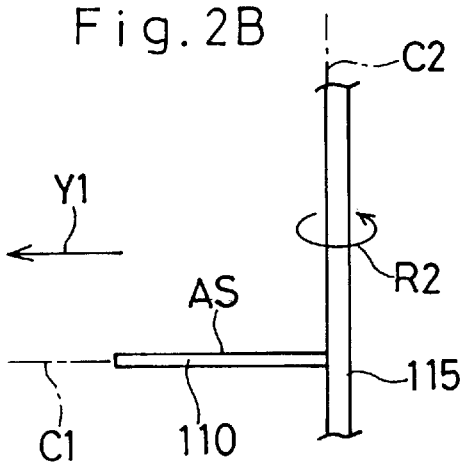
FIG. 2B is a side view of the loop antenna shown in FIG. 2A, showing a method of measuring the field gain of the loop antenna in a Y-axis direction.
Figure 2C:
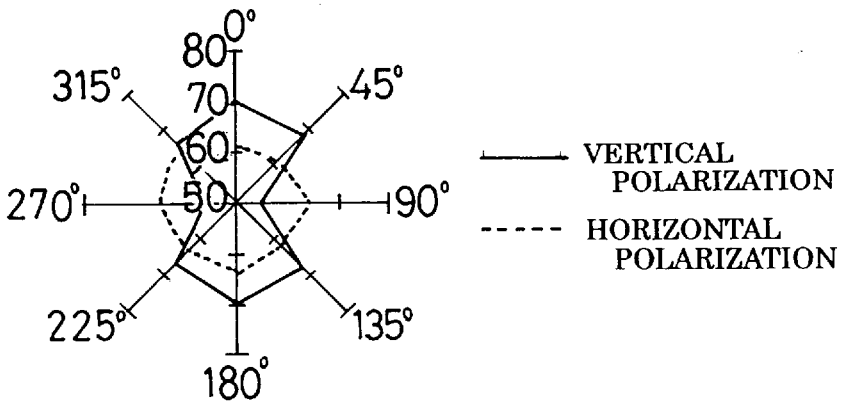
FIG. 2C is a directivity diagram showing a radiation pattern of the field gain measured according to the method shown in FIG. 2A.
Figure 2D:
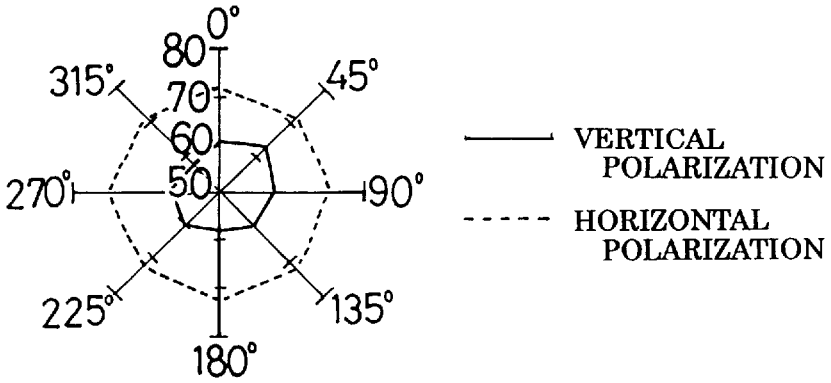
FIG. 2D is a directivity diagram showing a radiation pattern of the field gain measured according to the method shown in FIG. 2B.
Figure 3A:
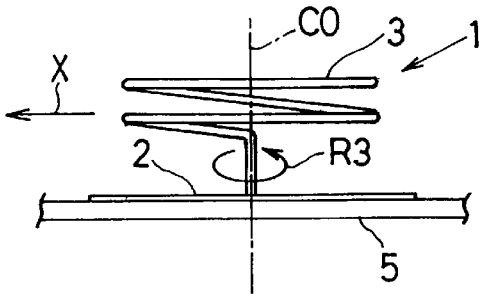
FIG. 3A is a front elevational view of the stereoscopic antenna of the present invention, showing a method of measuring the field gain of the stereoscopic antenna in an X-axis direction.
Figure 3B:
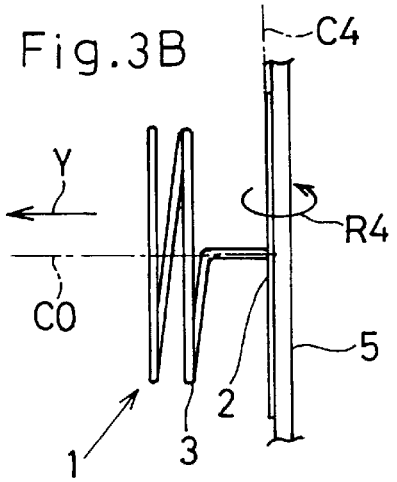
FIG. 3B is a side view of the stereoscopic antenna of FIG. 3A, showing a method of measuring the field gain of the stereoscopic antenna in a Y-axis direction.
Figure 3C:
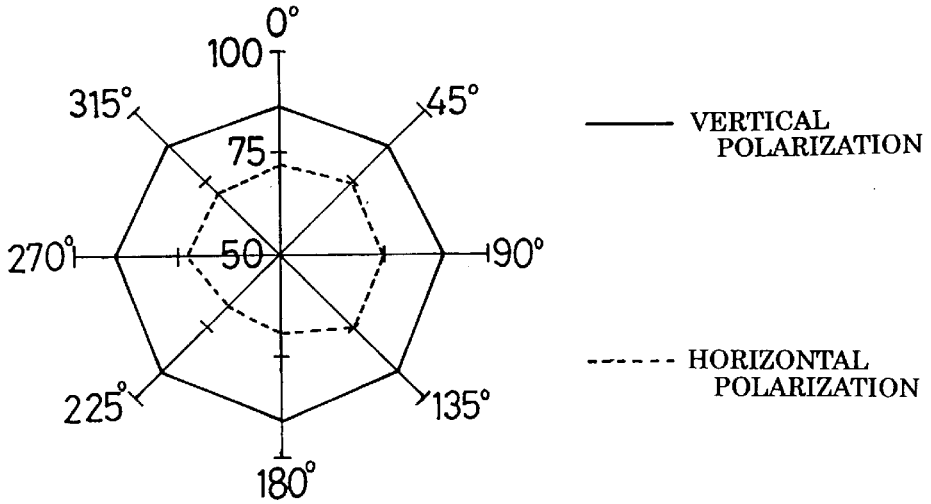
FIG. 3C is a directivity diagram showing a radiation pattern of the field gain measured according to the method shown in FIG. 3A.
Figure 3D:
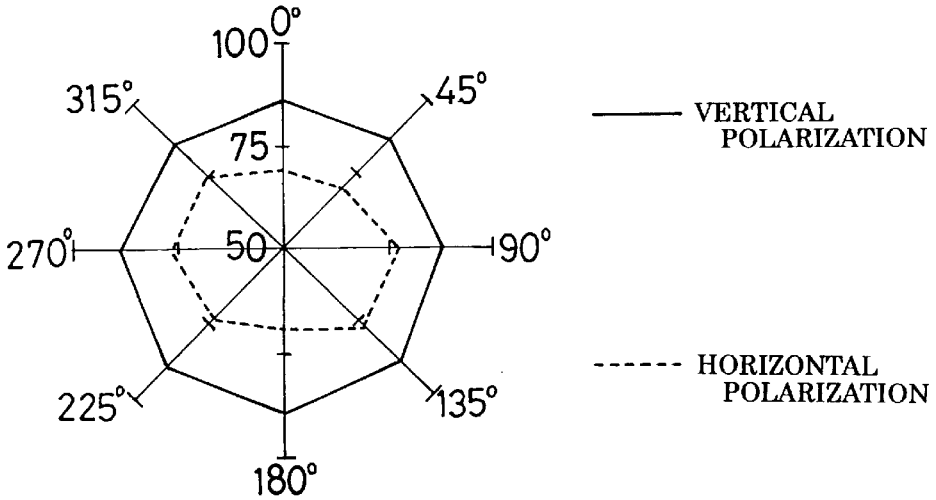
FIG. 3D is a directivity diagram showing a radiation pattern of the field gain measured according to the method shown in FIG. 3B.

The conventional circular loop antenna is shown in FIGS. 2A and 2B and the radiation patterns of the field gain exhibited such conventional circular loop antenna are shown in FIGS. 2C and 2D, whereas the stereoscopic antenna of the present invention is shown in FIGS. 3A and 3B and the radiation patterns of the field gain exhibited such stereoscopic antenna are shown in FIGS. 3C and 3D.

Referring first to FIGS. 2A and 2B, the conventional loop antenna 110 is mounted on and fitted to a substrate 115. An antenna plane AS bound by the circular loop antenna 110 lies perpendicular to the substrate 115. As shown in FIG. 2A, the field gain measured of a vertical polarization (shown by the solid line) and a horizontal polarization (shown by the broken line) in a horizontal X1 direction along the antenna plane AS and perpendicular to an antenna axis C1 while the loop antenna 110 is placed with the antenna axis C1 extending vertical is represented by the length radially from the center at 0° in FIG. 2C. The field gain measured of the vertical polarization and the horizontal polarization when the loop antenna 110 is turned 45° in a direction, shown by the arrow R1, about the antenna axis C1 perpendicular to the substrate 115 and passing through the center CE of the loop antenna 110 is represented by the length radially of the center at 45° shown in FIG. 2C. Thus, the solid line and the broken line used in FIG. 2C represent a radiation pattern of the field gain exhibited when the loop antenna 110 of FIG. 2A is turned in the direction shown by the arrow R1.

The solid line and the broken line used in FIG. 2D represent the radiation pattern of the field gain when the conventional loop antenna 110 is arranged as shown in FIG. 2B and is subsequently turned in the direction, shown by the arrow R2, about the axis C2 perpendicular to the antenna plane AS along a surface of the substrate 115 with respect to the horizontal Y1 direction along the antenna axis C1 taken as reference. Where the loop antenna 110 is arranged as shown in FIG. 2A, the field gain of the vertical polarization when the loop antenna 110 is turned 90° or 270° about the antenna axis C1 decreases with the field radiation pattern consequently being not uniform as shown in FIG. 2C, that is, the antenna is not isotropic.

Even the stereoscopic antenna of the present invention shown in FIGS. 3A and 3B is mounted on and fitted to the substrate 5 as hereinbefore described. The solid line and the broken line used in FIG. 3C represent a radiation pattern of the field gain exhibited when the stereoscopic antenna 1 is placed with the axis C0 of the antenna body 3 lying vertical and is subsequently turned in the direction, shown by the arrow R3, about the axis C0 with respect to the horizontal X direction perpendicular to the axis C0 taken as reference. FIG. 3D illustrates the radiation pattern of the field gain of the stereoscopic antenna 1 when the antenna body 3 has its axis C0 laid horizontally as shown in FIG. 3B and is subsequently turned in the direction, shown by the arrow R4, about an axis C4 perpendicular to the axis C0 along the electroconductive pattern 2 with respect to the horizontal Y direction along the axis C0 taken as reference. As can be seen from FIGS. 3C and 3D, even when the stereoscopic antenna 1 is turned in any one of the R3 and R4 directions, the field gain of the vertical polarization and that of the horizontal polarization do not vary considerably, and therefore, the antenna is isotropic. Also, the magnitudes of the respective field gains are greater than those of the conventional loop antenna shown in FIGS. 2C and 2D and it will readily be seen that the stereoscopic antenna 1 of the present invention is highly efficient.

Figure 4A:
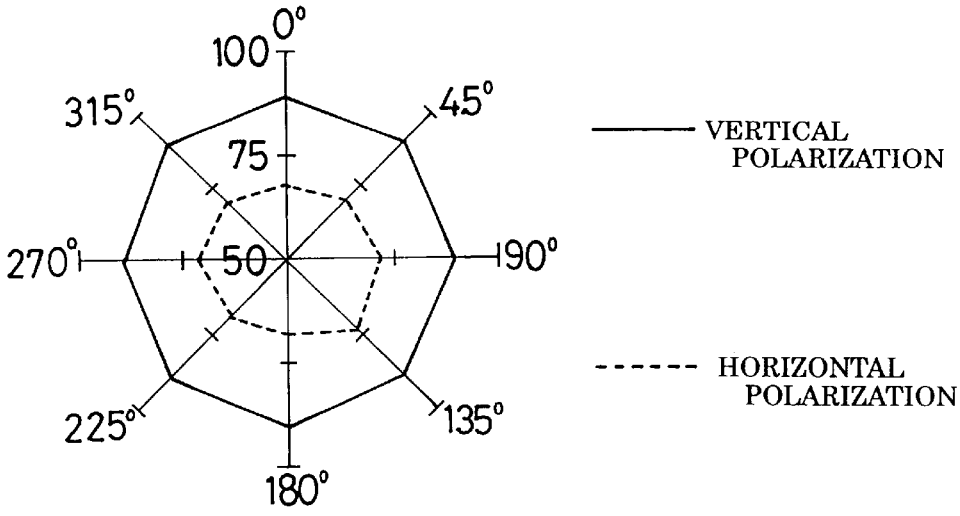
FIG. 4A is a directivity diagram showing a radiation pattern of the field gain measured according to FIG. 3A of the stereoscopic antenna having an antenna body 3 wherein the ratio H/D of the longer axis D relative to the height H is chosen to be 2.
Figure 4B:
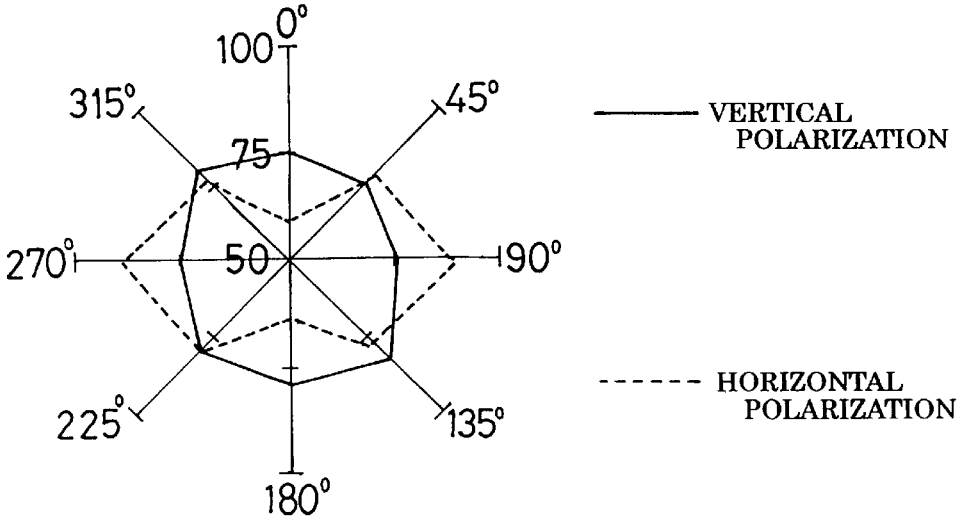
FIG. 4B is a directivity diagram showing a radiation pattern of the field gain measured according to FIG. 3B of the stereoscopic antenna having the antenna body 3 wherein the ratio H/D of the longer axis D relative to the height H is chosen to be 2.
Figure 5A:
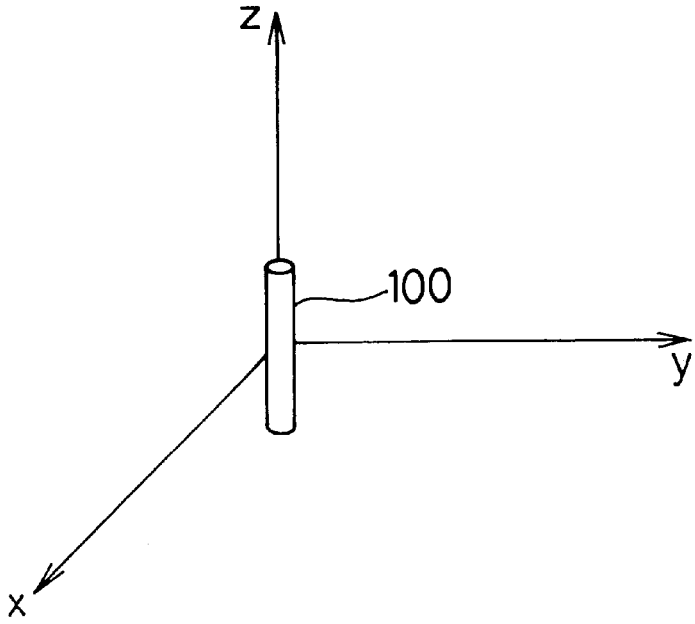
Fig.5A PRIOR ART
FIG. 5A is a perspective view of the prior art micro dipole antenna.
Figure 5B:
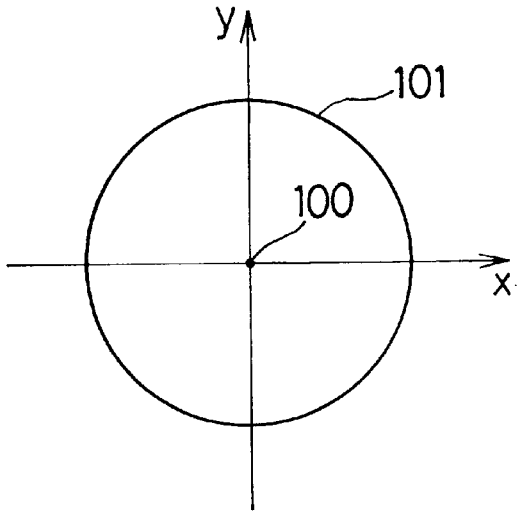
Fig. 5B PRIOR ART
FIG. 5B is a diagram showing the directivity of the micro dipole antenna of FIG. 5A in a plane perpendicular to the micro dipole antenna.
Figure 5C:
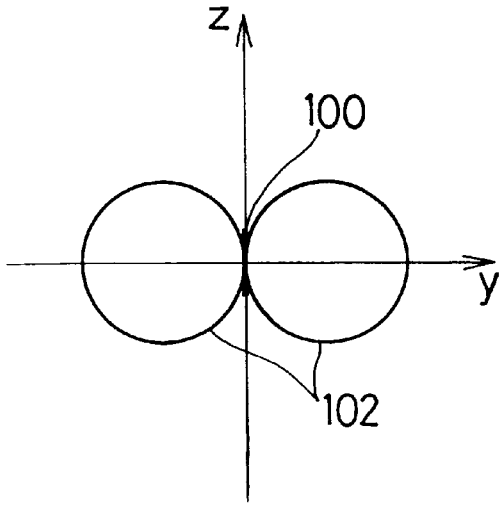
Fig. 5C PRIOR ART
FIG. 5C is a diagram showing the directivity of the micro dipole antenna of FIG. 5A in a plane containing the micro dipole antenna.
Figure 6A:
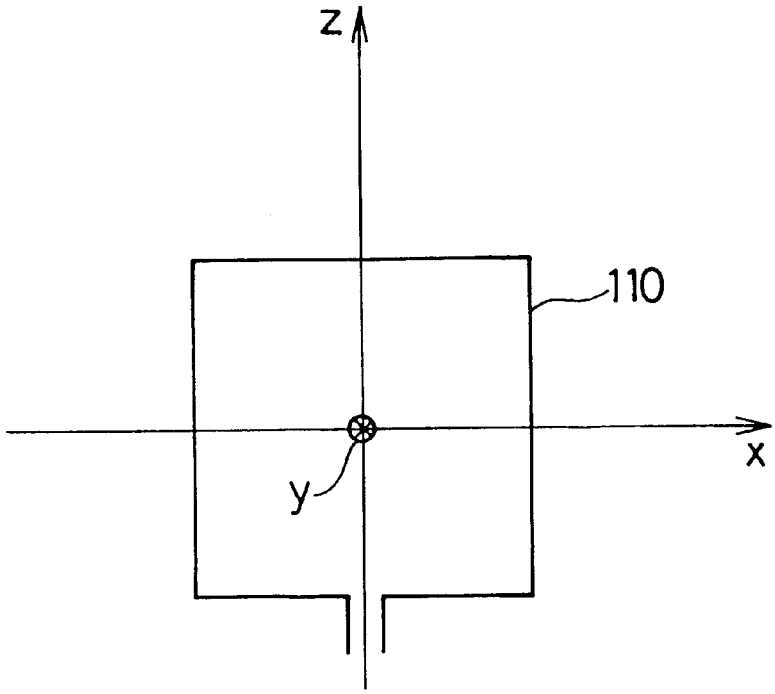
Fig.6A PRIOR ART
FIG. 6A is a front elevational view of the prior art loop antenna.
Figure 6B:
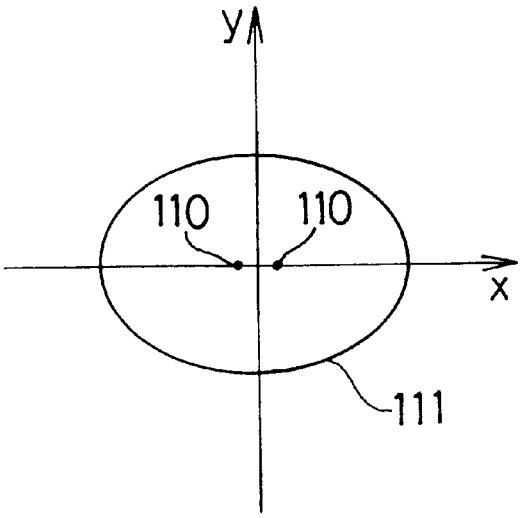
Fig.6B PRIOR ART
FIG. 6B is a diagram showing the directivity of the loop antenna of FIG. 6A in a plane perpendicular to the loop antenna.
Figure 6C:
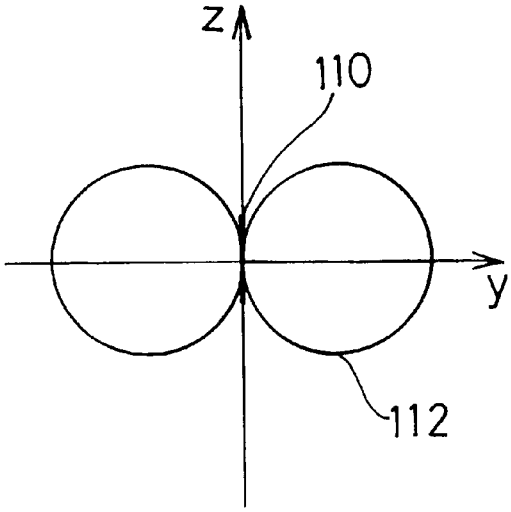
Fig.6C PRIOR ART
FIG. 6C is a diagram showing the directivity of the loop antenna of FIG. 6A in a plane containing the loop antenna.

FIGS. 4A and 4B illustrate, for comparison purpose, the field radiation pattern exhibited when the ratio H/D of the diameter D of the antenna body 3 of the stereoscopic antenna of FIG. 1B relative to the height H of such antenna body 3 from the electroconductive pattern 2 is chosen to be 2. The solid line and the broken line used in FIG. 4A represent a radiation pattern of the field gain when the antenna body 3 is placed with the axis C0 extending vertical as shown in FIG. 3A and is subsequently turned in the direction, shown by the arrow R3, about the axis C0 with respect to the horizontal X direction perpendicular to the axis C0 taken as reference, in a manner substantially similar to that shown in FIG. 3C. The solid line and the broken line used in FIG. 4B represent a radiation pattern of the field gain when the antenna body 3 is placed with the axis C0 extending horizontal as shown in FIG. 3B and is subsequently turned in the direction, shown by the arrow R4, about the axis C4 perpendicular to the axis C0 along the electroconductive pattern 2 with respect to the horizontal Y direction parallel to the axis C0 taken as reference, in a manner substantially similar to that shown in FIG. 3D. As shown in FIG. 4B, when the stereoscopic antenna 1 is arranged 0° or is turned 180° about the antenna axis C4, the field gain of the horizontal polarization decreases with the field radiation pattern consequently being not uniform, that is, the antenna is not isotropic.

Although the present invention has been fully described in connection with the preferred embodiment thereof with reference to the accompanying drawings which are used only for the purpose of illustration, those skilled in the art will readily conceive numerous changes and modifications within the framework of obviousness upon the reading of the specification herein presented of the present invention. Accordingly, such changes and modifications are, unless they depart from the scope of the present invention as delivered from the claims annexed hereto, to be construed as included therein.

What is claimed is:

1. A stereoscopic antenna which comprises:

a planar electroconductive pattern adapted to be electrically grounded;

a loop-shaped antenna body having an axis lying perpendicular to the planar electroconductive pattern, and;

an antenna connection for connecting the antenna body to the planar electroconductive pattern to enable tuning of the stereoscopic antenna by a combination of the antenna body with the planar electroconductive pattern;

wherein a ratio H/D of a longer diameter D of the antenna body, as measured in a direction along a major axis thereof, relative to a height H of the antenna body as measured from the planar electroconductive pattern is chosen to be within the range of 0.1 to 1.

2. The stereoscopic antenna as claimed in claim 1, wherein the electroconductive pattern has a portion extending substantially circumferentially thereof and positioned so as to confront the antenna body in an axial direction thereof.

3. The stereoscopic antenna as claimed in claim 1, wherein the electroconductive pattern has a shape which is the same as the antenna body as viewed in an axial direction thereof.

4. The stereoscopic antenna as claimed in claim 1, wherein the electroconductive pattern is formed by patterning an electroconductive path on a substrate.

5. The stereoscopic antenna as claimed in claim 1, wherein the ratio H/D of the longer diameter D of the antenna body relative to the height H of the antenna body as measured from the planar electroconductive pattern is chosen to be 0.5.

6. The stereoscopic antenna as claimed in claim 1, wherein the antenna body is a circular loop.

7. The stereoscopic antenna as claimed in claim 1, wherein the antenna body has a number of turns which is within the range of 1 to 4.

8. The stereoscopic antenna as claimed in claim 1, wherein the antenna body and the antenna connection are formed from a single electroconductive wire.

9. The stereoscopic antenna as claimed in claim 1, wherein the antenna connection extends parallel to the axis of the antenna body.

10. A stereoscopic antenna unit comprising:

a substrate;

a flat electroconductive closed loop pattern supported by the substrate;

an antenna connection member electrically connected to and extending perpendicularly from the electroconductive pattern; and a spirally looped antenna body attached to the antenna connection member and having a central axis perpendicular to the electroconductive pattern, the spirally looped antenna body having an upper surface offset and parallel to a surface of the flat electroconductive pattern with a number of looped turns being within the range of 1 to 4 wherein a maximum width of the spirally looped antenna along the upper surface, D is offset by a height, H, from the flat electroconductive pattern and is within the following condition:

$$1 \geqq H/D \geqq 0.1.$$

11. The stereoscopic antenna unit as claimed in claim 10, wherein the electroconductive closed loop pattern is a ring having an inner diameter of approximately D.

12. A stereoscopic antenna comprising:

a closed loop planar electroconductive pattern electrically grounded;

a loop-shaped antenna body having an axis lying perpendicular to the planar electroconductive pattern and spaced a distance H above the planar electroconductive pattern, and;

an antenna connection for connecting the antenna body to the planar electroconductive pattern so as to accomplish tuning of the stereoscopic antenna by a combination of the antenna body with the planar electroconductive pattern;

wherein a ratio H/D of a longer diameter D of the antenna body, as measured in a direction along a major axis thereof, relative to a height H of the antenna body as measured from the planar electroconductive pattern is approximately 0.5.

13. The stereoscopic antenna as claimed in claim 12, wherein the closed loop planar electroconductive pattern has a shape which is the same as the loop-shaped antenna body as viewed in an axial direction thereof.

14. The stereoscopic antenna as claimed in claim 13 wherein the loop-shaped antenna body has 2 loops.

* * * * *